US006514114B1

(12) United States Patent
Ishigaki et al.

(10) Patent No.: US 6,514,114 B1
(45) Date of Patent: Feb. 4, 2003

(54) VEHICLE-LAMP ASSEMBLY APPARATUS

(75) Inventors: Akio Ishigaki, Shizuoka (JP); Shigeru Yamamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/578,493

(22) Filed: May 26, 2000

(30) Foreign Application Priority Data

May 26, 1999 (JP) ..... 11-146686

(51) Int. Cl.[7] ..... H01K 3/00
(52) U.S. Cl. ..... 445/66
(58) Field of Search ..... 445/23, 66

(56) References Cited

U.S. PATENT DOCUMENTS 5,887,430 A * 3/1999 Hirai et al. ..... 60/433

FOREIGN PATENT DOCUMENTS

GB 2221659 2/1990

* cited by examiner

*Primary Examiner*—Kenneth J. Ramsey
(74) *Attorney, Agent, or Firm*—Sughrue Mion, PLLC

(57) ABSTRACT

A vehicle-lamp assembly apparatus having: a lower jig (120) for supporting a workpiece (300), a jig support table (10) on which the lower jig (120) is positioned and mounted, and an upper jig (110) incorporating the lower jig (120) as a jig (100) by vertically engaging therewith, supporting any other workpiece (200) when necessary and including electric equipment (530) and (540) which functions to perform predetermined processes to the workpiece. The apparatus also includes an upper jig support plate (24) for supporting the upper jig (110) incorporated via a coupling mechanism (27) in a suspended condition, and an elevator mechanism (22) for moving up and down the upper jig support plate (24) with respect to the jig support table (10). First and second connector portions (510 and 520) are automatically joined together and separated from each other without making the worker do so by hand and this eliminates the possibility of connecting the connector portions improperly.

10 Claims, 9 Drawing Sheets

VEHICLE-LAMP ASSEMBLY APPARATUS

BACKGROUND OF THE INVENTION

1. Field of the Invention

This invention relates to a vehicle-lamp assembly apparatus installed on vehicle-lamp assembly lines and more particularly to a vehicle-lamp assembly apparatus so arranged as to be able to apply a predetermined process to a lamp component member supported by a lower jig and to any other lamp component member supported by an upper jig when necessary by using electric/fluid equipment provided to the upper jig.

2. Description of the Related Art

On a headlamp assembly line, a plurality of assembly apparatuses are usually employed so that predetermined processes may be performed. Members constituting an aiming mechanism are arranged by a first apparatus in a lamp body, included as a part of a workpiece. The workpiece is then transferred to a second apparatus to make the aiming mechanism support a reflector. Further, the workpiece is transferred to a third apparatus wherein a seal member is fitted in a seal groove and a front lens is pressure-welded to the lamp body by engaging a seal leg with the seal groove. The workpiece is then transferred to a fourth apparatus wherein the front lens and the seal leg are fastened mechanically with a clip or a fastening screw. The workpiece is finally transferred to a fifth apparatus wherein an aiming adjustment is made with respect to light distribution of the lamp by lighting the lamp.

In order to facilitate the assembly work applied to the lamp body and the front lens as lamp component members in each of the assembly apparatuses on such a headlamp assembly line as mentioned above, the component members are respectively supported by corresponding jigs before being set in each assembly apparatus. Then the component parts are assembled and subjected to inspection.

Although demand for increasing the assembling functions in each of the assembly apparatuses employed on the lamp assembly is still great, increasing the number of pieces of equipment to be installed in the assembly apparatus is not preferable because such an assembly apparatus would become greater in both size and complexity.

Therefore, the present inventors reasoned that provision of electric/fluid equipment for a jig would result in a decrease in the number of assembly apparatuses to be employed on an assembly line and shorten the length of the assembly line, without increasing the size of such an assembly apparatus, by allowing the equipment to replace the functions performed by any other apparatus.

However, the jig is originally designed to be compact and lightweight so that it may be set within the assembly apparatus while supporting the lamp component member as a workpiece. It is consequently difficult to provide the jig with any element (hereinafter called the operating element) supply source for operating current/compressed-air equipment in addition to the electric/fluid equipment.

Further, the present inventors reasoned that current/compressed air, used as the operating element, could be supplied to the electric/fluid equipment to operate the equipment by connecting electric wires and air pipes on the assembly apparatus side to those extending to the electric/fluid equipment provided for the jig via connectors.

However, a connector-to-connector connection is needed each time the lamp component member as the workpiece together with the jig is set in the assembly apparatus and this work is not only troublesome but also poses a serious problem arising from the possibility of connecting the connectors improperly where a large number of connectors exist.

An object of the present invention, made in view of the foregoing problems found in the prior art, is to provide a vehicle-lamp assembly apparatus that improves assembly functions without providing a jig for supporting any lamp component member with electric/fluid equipment, without increasing the size of the assembly apparatus and complicating the construction thereof and without imposing any additional task on the worker.

SUMMARY OF THE INVENTION

In order to accomplish the object above, a vehicle-lamp assembly apparatus comprises: a lower jig for supporting a lamp component member; a jig support table on which the lower jig is positioned and mounted, an upper jig vertically engaged with the lower jig, with the upper jig supporting another lamp component member when necessary and including electric and/or fluid equipment which functions to permit a predetermined process to be performed on the lamp component member. The assembly apparatus also includes an upper jig support plate for supporting the upper jig incorporated via a coupling mechanism in a suspended condition; and an elevator mechanism for moving up and down the jig support plate with respect to the jig support table. The upper jig support plate includes a first passage for supplying electricity and/or fluid to the electric and/or fluid equipment, and the upper jig includes a second passage extending to the first equipment. The first and second equipment-operating element supply passages are connected via a connector including a first connector portion on the first supply passage side and a second connector portion on the second supply passage side, the first and second connector portions being detachable from each other, wherein the electricity and/or fluid are supplied to the electric and/or fluid equipment via the first and second passages, and the first connector portion being movable relative to the upper jig support plate.

As the connector mentioned above, a connector for connecting electric wires or a coupler for connecting fluid pipes may be employed.

In such a condition that the upper jig support plate and the upper jig can be coupled together by lowering the upper jig support plate with respect to the jig (of the upper jig) mounted on the jig support table, the first connector portion on the upper jig support plate side vertically engages with the second connector portion on the upper jig side and is made also disengeable from the second connector when the first connector is moved up and down relative to the upper jig support plate.

More specifically, the first connector portion thus. lowered with respect to the upper jig support plate is inserted into the second connector portion and this makes the first equipment-operating element supply passage connected to the second equipment-operating element supply passage and supplies the equipment-operating element to the equipment of the lower jig. Thus, the equipment is made operational.

When the first connector portion is moved up with respect to the upper jig support plate from the condition in which the first and second connector portions have been joined, the first connector portion is removed from the second connector portion, so that the first equipment-operating element supply passage is separated from the second equipment-operating element supply passage.

Additionally, the vehicle-lamp assembly apparatus is provided with a positioning mechanism between the first connector portion on the upper jig support plate side and the second connector portion on the upper jig side.

The positioning mechanism regulates the positions of the first and second connector portions so that the first connector portion can be vertically inserted into or removed from the second connector portion.

The vehicle-lamp assembly apparatus can have a positioning mechanism wherein the positioning mechanism includes a slide plate incorporated with the upper jig support plate and capable of horizontally sliding by a predetermined quantity, a positioning pin in the form of a pointed end that is directed downward from the slide plate, and an engagement hole for engaging with the positioning pin.

When at least the front end portion of the positioning pin engages with the engagement hole, the slide plate horizontally slides as the upper jig support plate lowers and causes the positioning pin to be inserted into the engagement hole, whereby the first connector portion on the upper jig support plate side can vertically be inserted into and removed from the second connector portion on the upper jig side.

DETAILED DESCRIPTION OF THE PREFERRED EMBODIMENTS

Figure 1:
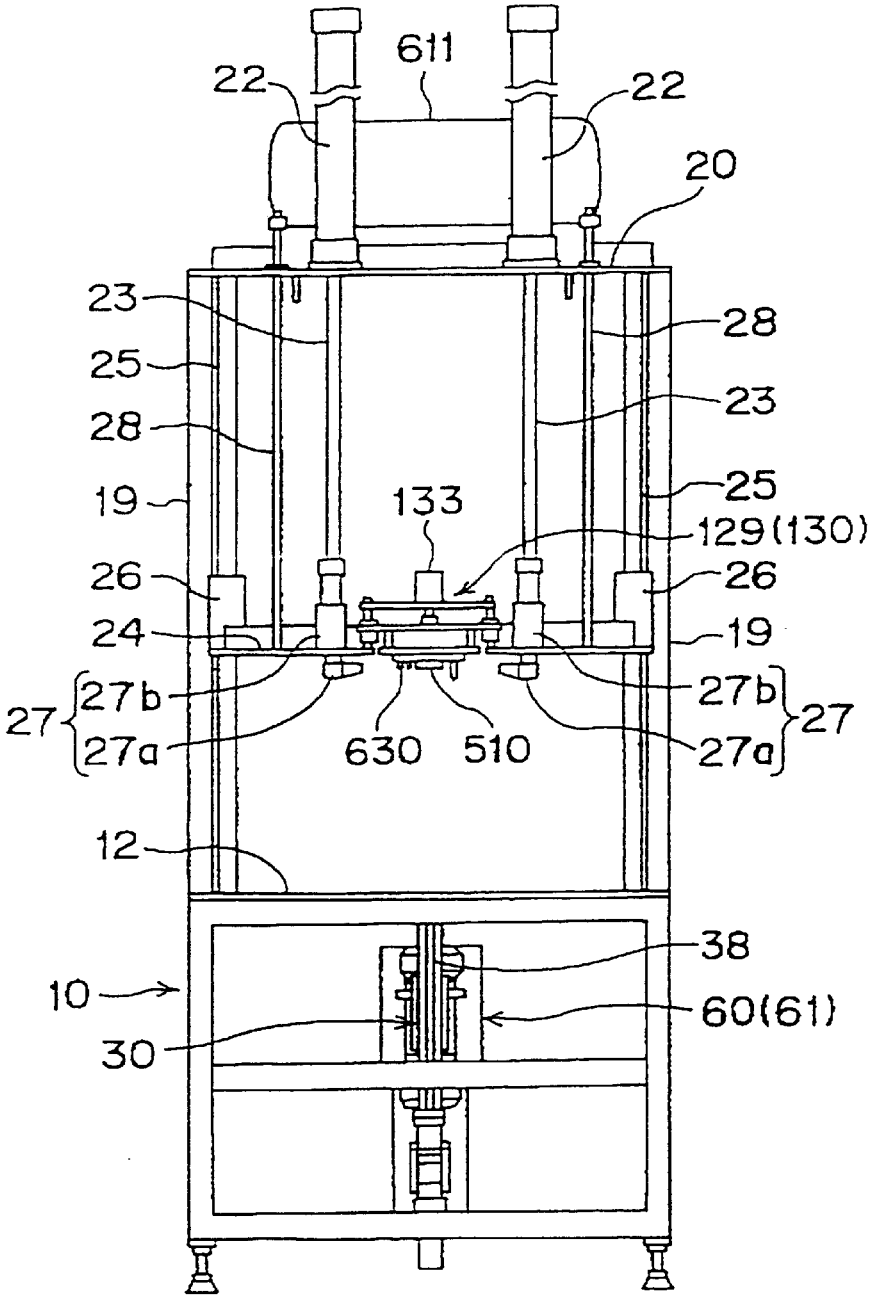
FIG. 1 illustrates an elevational view of a pressure-welding automatic screw fastening unit between the body and lens of a headlamp in a first embodiment of the invention.
Figure 2:
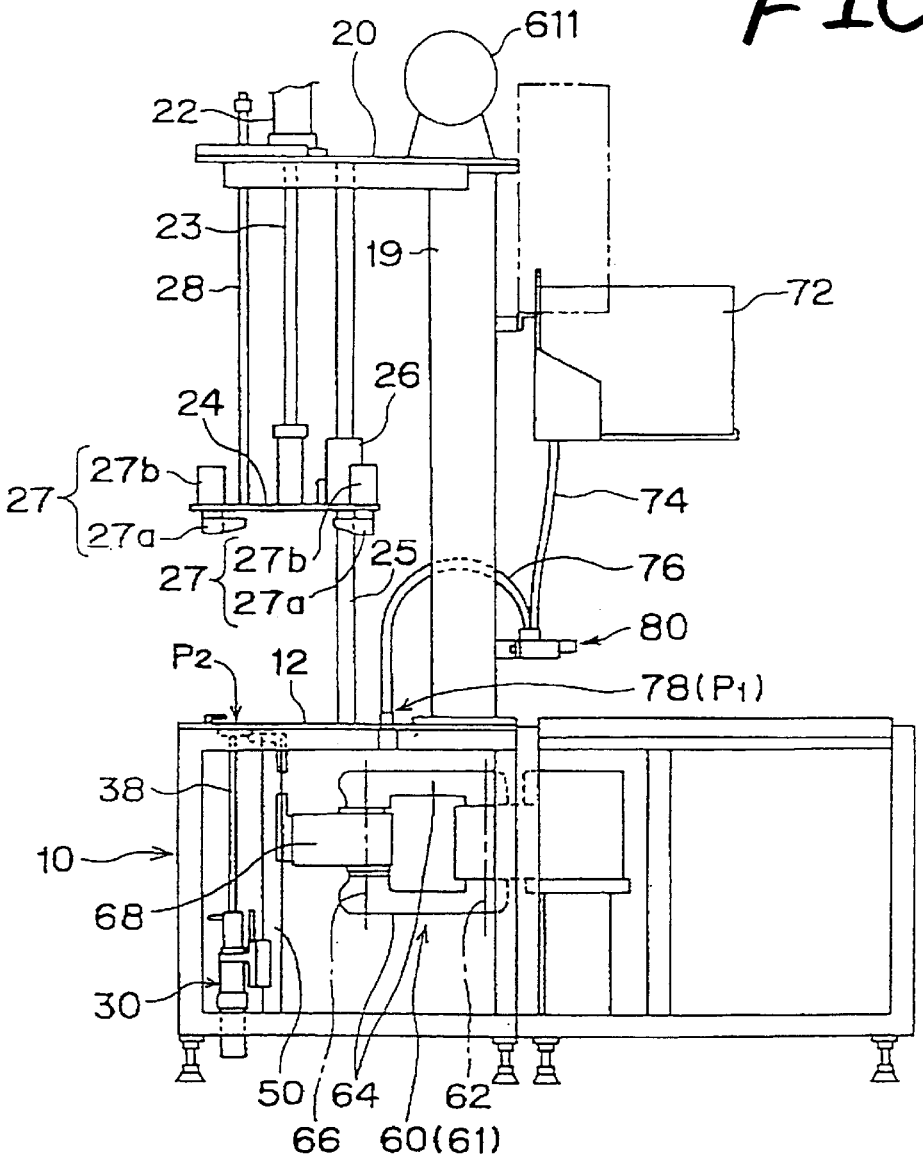
FIG. 2 shows a side view of the unit of FIG. 1.
Figure 3:
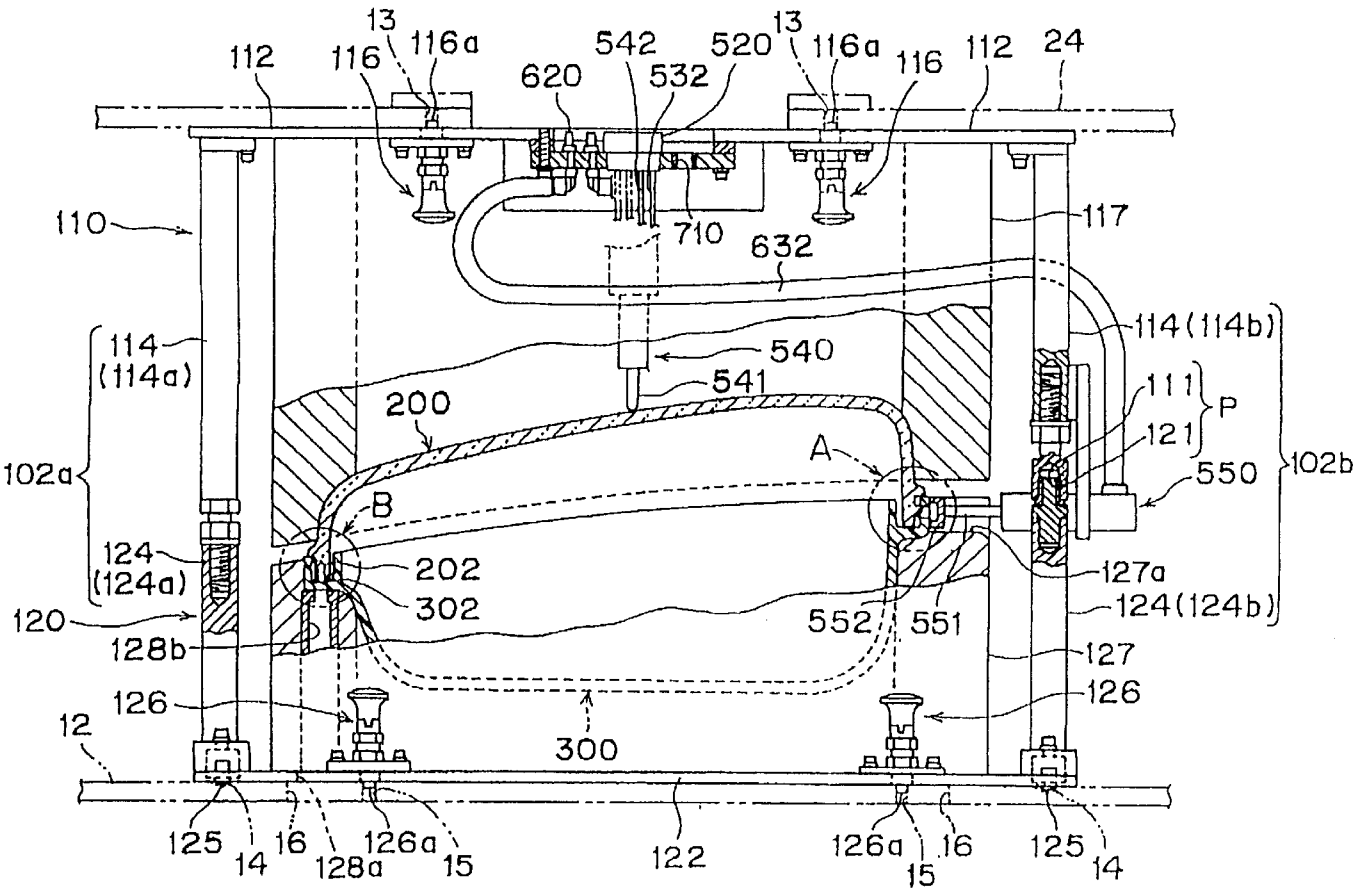
FIG. 3 illustrates an elevational view of a jig for use in the unit.
Figure 4:
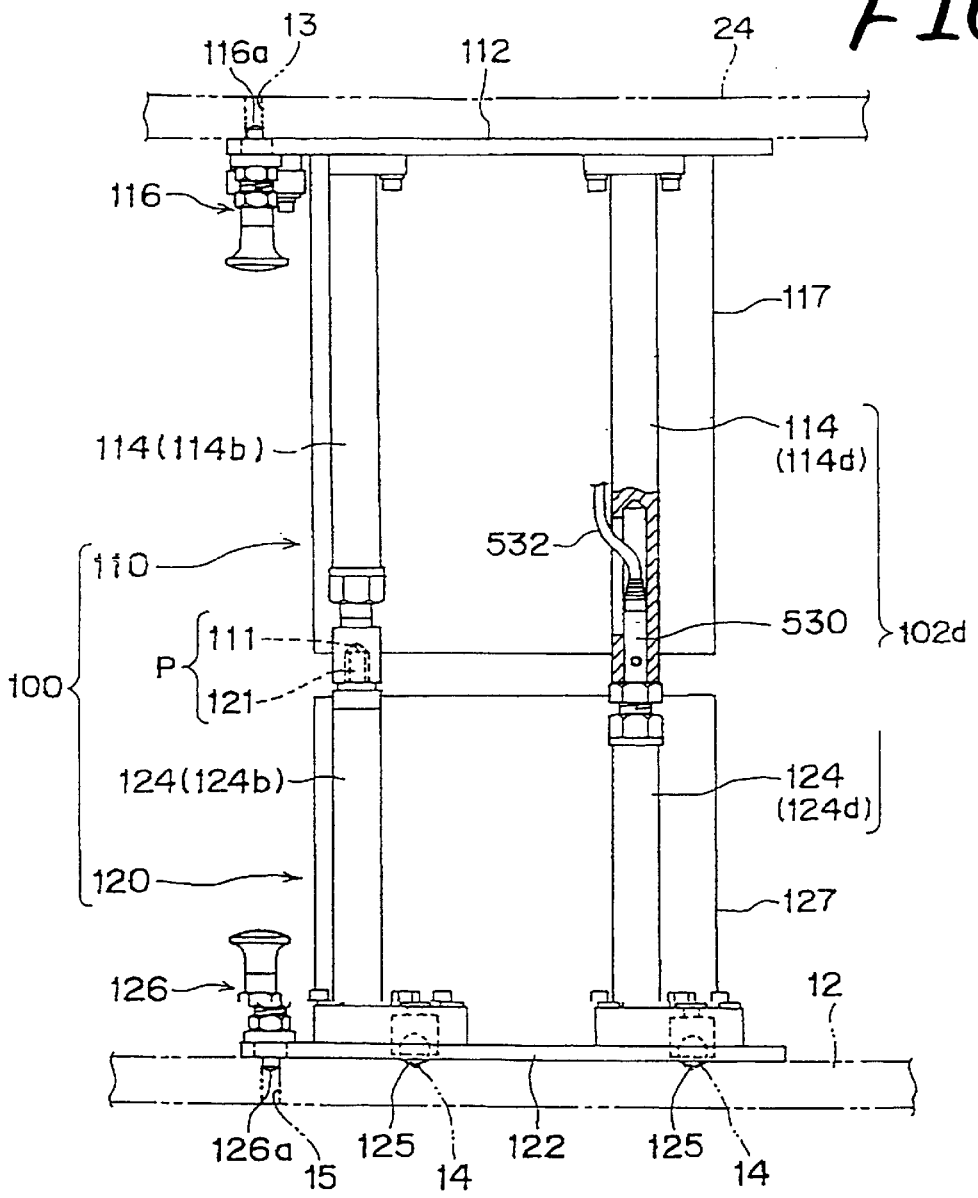
FIG. 4 shows a side view of the jig of FIG. 3.
Figure 5:
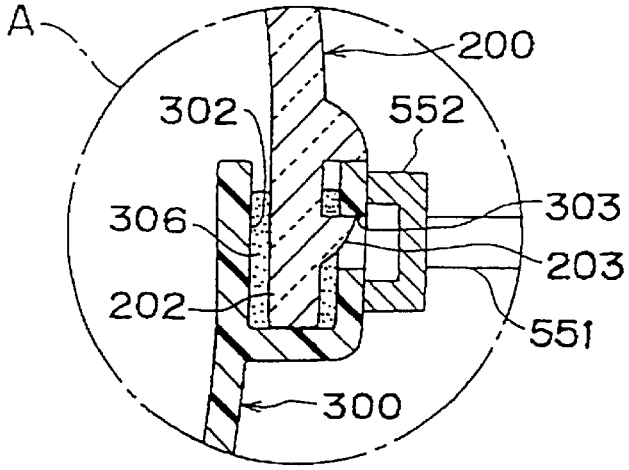
FIG. 5 shows an enlarged sectional view of an irregular lance engagement portion between a seal groove and a seal leg.
Figure 6:
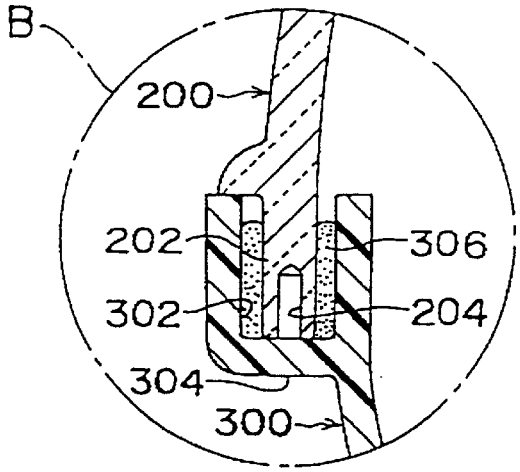
FIG. 6 illustrates an enlarged sectional view of a screw fastening portion between the seal groove and the seal leg.
Figure 7:
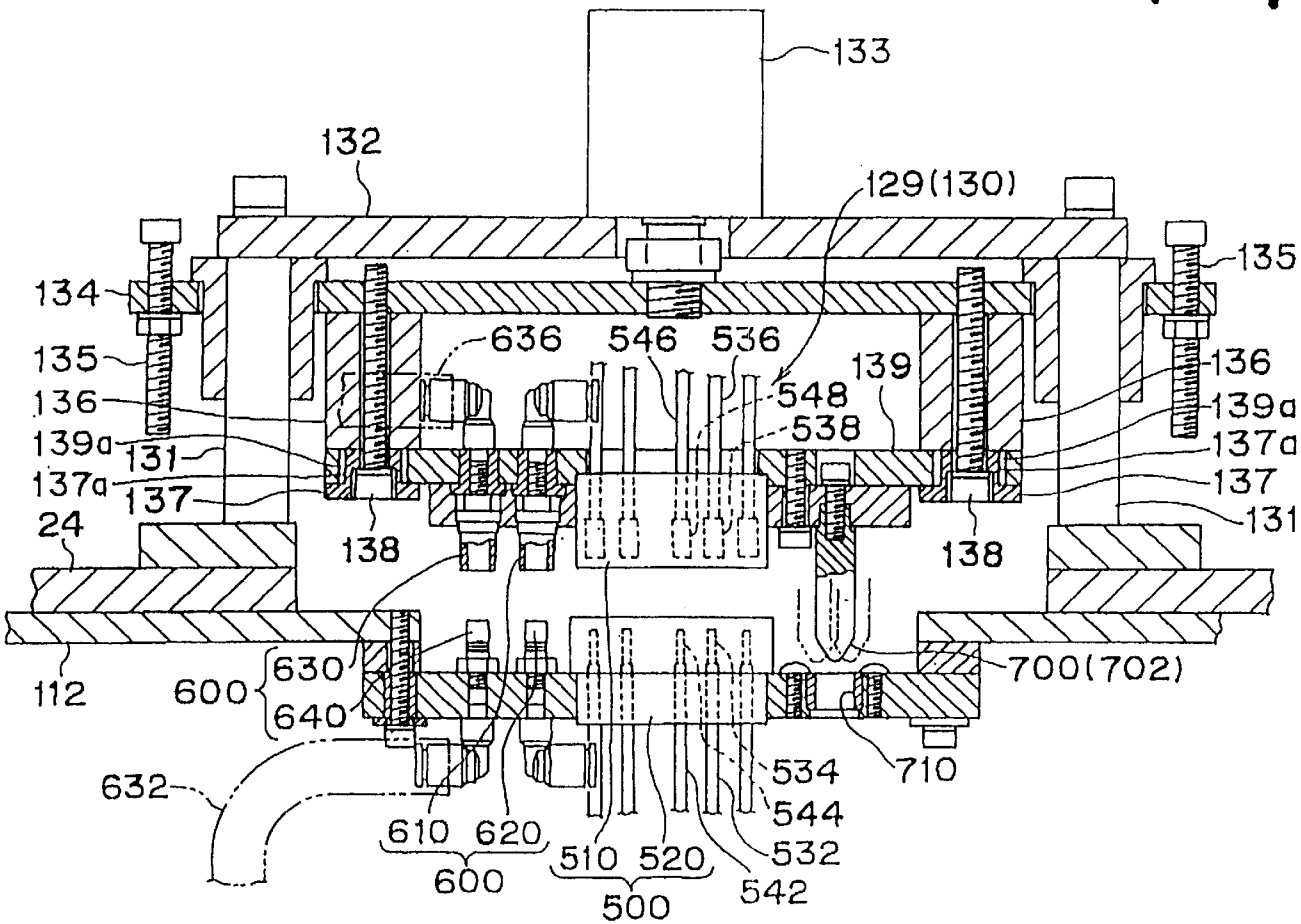
FIG. 7 shows an elevational view of the periphery of a connector before the connector portion is inserted.
Figure 8:
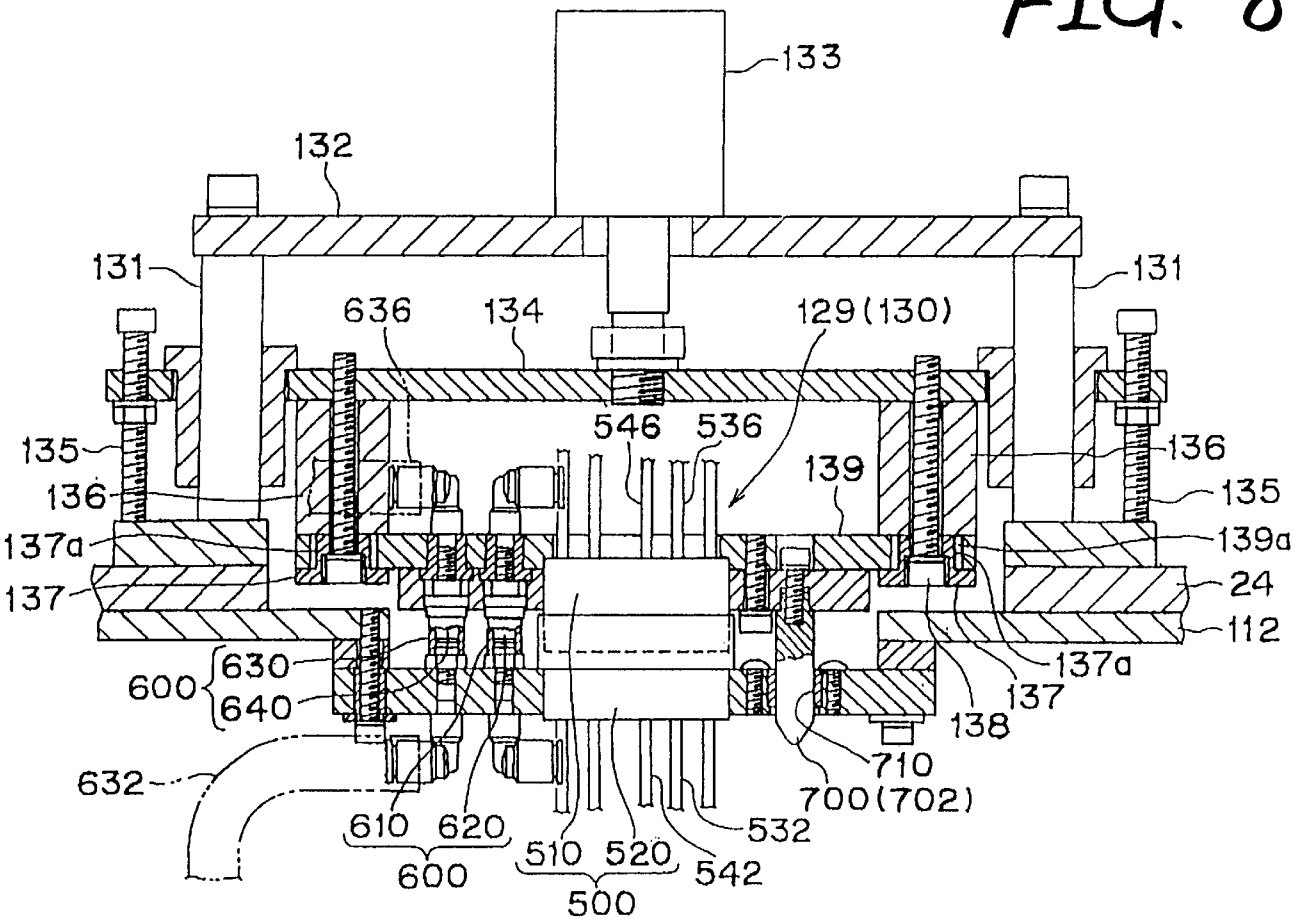
FIG. 8 shows an elevational view of the periphery of the connector after the connector portion is inserted.
Figure 9:
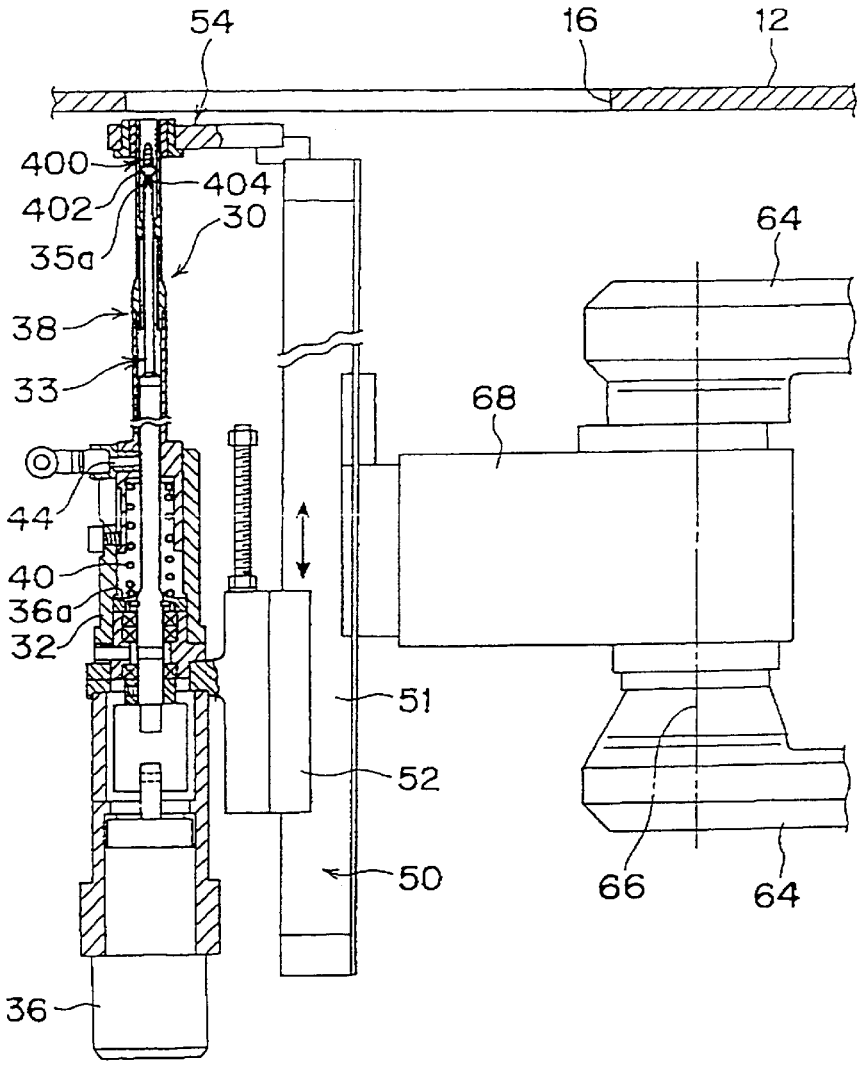
FIG. 9 illustrates an overall configuration of a screw fastening mechanism.
Figure 10:
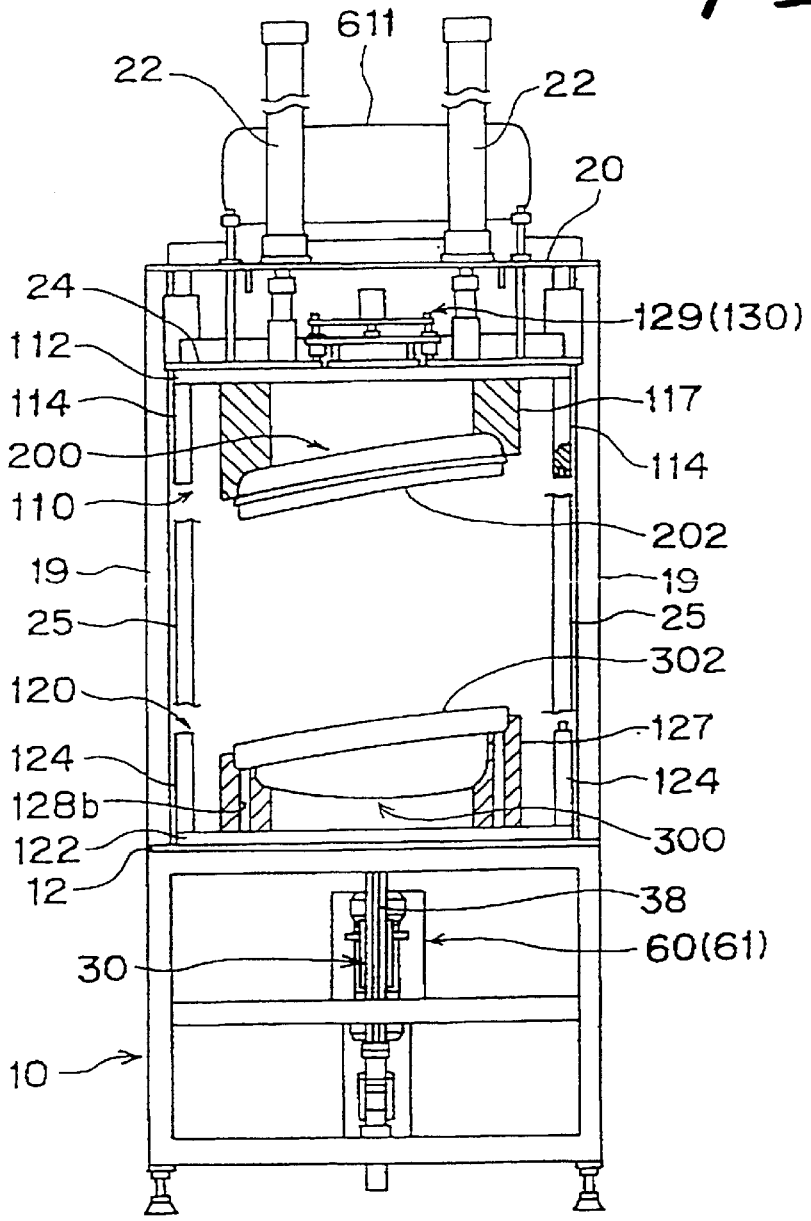
FIG. 10 shows an elevational view of the unit with the jig that has been set.

FIGS. 1 to 8 shows a vehicle-lamp assembly apparatus as a first embodiment of the invention, wherein FIG. 1 is an elevational view of a pressure-welding automatic screw fastening unit between the body and lens for a headlamp as the first embodiment thereof; FIG. 2, a side view of the unit; FIG. 3, an elevational view showing a section of part of the jig used in the unit; FIG. 4, a side view showing a section of part of the jig; FIG. 5, an enlarged sectional view of an irregular lance engagement portion between a seal groove and a seal leg; FIG. 6, an enlarged sectional view of a screw fastening portion between the seal groove and the seal leg; FIG. 7, a sectional view of the periphery of a connector before the connector portion is inserted; and FIG. 8, a sectional view of the periphery of the connector after the connector portion is inserted. Further, FIG. 9 is an overall configuration of a screw fastening mechanism; and FIG. 10, an elevational view of the unit with the jig that has been set.

In these drawings, the whole pressure-welding automatic screw fastening unit between the body and lens for the headlamp is a rectangular frame in structure as viewed from its front and side. A bed plate 12 capable of mounting a lower jig 120 thereon is provided to a rectangular jig support table containing a screw fastener body 30. A top plate 20 supported by a pair of lateral side frames 19 and 19 is provided above the jig support table 10. An upper jig support plate 24 that is moved up and down by air cylinders 22 as elevator mechanisms is provided to the top plate 20.

The lower end portion of the cylinder rod 23 of each air cylinder 22 is coupled to an upper jig support plate 24. A guide 26 provided to the upper jig support plate 24 is slidably fitted to each guide shaft 25 disposed between the top plate 20 and the jig support table 10. Each second guide shaft 28 is also disposed between the top plate 20 and the upper jig support plate 24.

A clamper 27 as a coupling mechanism for holding an upper jig 110 in a suspended condition is provided in four places on the underside of the upper jig support plates 24 and so configured that its clamp pawl 27*a* is made to horizontally pivot by an air cylinder 27*b*. On the other hand, positioning plungers 116 for holding plunger pins 116*a* in such a way as to be projected upward from an upper plate 112 by means of spring force are provided to the respective upper jigs 110.

When the upper jig support plate 24 is lowered to a jig 100 thus positioned on the bed plate 12, an engagement hole 13 in the upper jig support plate 24 engages with the plunger pin 116*a* projected upward, whereby the upper jig 110 is positioned relative to the upper jig support plate 24. Further, the upper jig 110 is integrally coupled to the upper jig support plate 24 by operating the clampers 27 in such a condition that the jig 100 (upper jig 110) is kept in contact with the upper jig support plate 24 so as to clamp the longitudinal side edge portions of the upper jig 110 with the upper jig support plate 24 and the clamp pawls 27*a*.

As shown in FIGS. 1 and 7, an internal connector 510 as part of the connector on the supply source side of an equipment operating element and internal couplers 610 and 630 are provided in the center of the lateral direction of the front side edge of the upper jig support plate 24. On the other hand, an external connector 520 as a connector portion on the side of the equipment (a proximity switch 530, a limit switch 540 and an air cylinder 550 for correcting the irregular lance engagement portion) are provided to the upper jig 110. Further, an insert mechanism 129 for positioning the connector (as will be described in detail) provided to the upper jig support plate 24 makes the internal connector 510 and the internal couplers 610 and 630 on the side of the upper jig support plate 24 insertable into and removable from the external connector 520 and the external couplers 620 and 640 on the side of the upper jig 110 when the upper jig support plate 24 is coupled to the upper jig 110.

An unidirectional spherical roller 125 is provided at the four corners of the base portion of the lower jig 120 so that the lower jig 120 may easily run on the bed plate 12. There are also provided holes 14 (see FIGS. 3 and 4) with which the roller 125 of the lower jig 120 can engage and when the rollers 125 of the lower jig 120 are thus caused to engage with the respective holes 14 of the bed plate 12, the base of the lower jig 120 is brought into contact with the bed plate 12, and the lower jig 120 is substantially placed in position on the bed plate 12. Further, a positioning plunger 126 is provided to the lower plate 122 of the lower jig 120 and by pivoting the plunger 126, a plunger pin 126*a* can be urged to project downward from the lower plate 122 or retract in the lower plate 122 and held therein. When the plunger pin 126*a* is mated with a pin engagement hole 15 of the lower jig 120, the lower jig 120 is accurately placed in position on the bed plate 12.

The jig 100 used in this apparatus is, as shown in FIGS. 3 and 4, so constructed that the equally-dimensioned rectangular upper and lower plates 112 and 122 are securely coupled with four supports 102 (102*a*, 102*b*, 102*c* and 102*d*, (102*c* is not shown)), which can each be vertically divided into two parts in the substantially central portion in the longitudinal direction.

More specifically, the jig 100 is constituted of the upper jig 110 with four legs 114 (114*a*, 114*b*, 114*c* and 114*d*, (114*c* is not shown)) extended downwardly from the upper plate 112, and the lower jig 120 with four legs 124 (124*a*, 124*b*, 124*c* and 124*d*, (124*c* is not shown)) extended upward from the lower plate 122. The four legs 114 and 124 are respectively located in matching positions and the pair of legs 114*b* and 124*b* (114*c* and 124*c*) forming the support 102*b* (102*c*) diagonally positioned are made to irregularly engage with each other in the axial direction, whereby the upper and lower jigs 110 and 120 are properly positioned and combined together as the jig 100. Reference letter P in FIGS. 3 and 4 denotes an irregular engagement portion including a recessed portion 111 of the leg 114 and a projected portion 121 of the leg 124.

The proximity switch 530 (see FIG. 4) is provided within the lower end portion of the leg 114*d* of the upper jig 110 and when the upper jig support plate 24 suspending and supporting the upper jig 110, detects that the leg 114*d* of the lower jig 120 is placed in position close to the corresponding 124*d*. A power supply cord for supplying power to the proximity switch 530 is connected to an external terminal 534 contained in the external connector 520.

The upper jig 110 is provided with a cylindrical lens-supporting frame 117 capable of supporting the outer peripheral edge portion of front lens 200 whereby to fit the front lens 200 into the support frame 117 from below with its seal leg 202 directed downward. A limit switch 540 of FIG. 3 for detecting whether the front lens 200 has actually been set to the support frame 117 is fixed to the upper plate 112 of the upper jig 110, and its contactor 541 is urged downward to project therefrom. A power supply cord 542 for supplying power to the limit switch 540 is passed through the side wall of the support frame 117 and connected to an external terminal 544 contained in the external connector 520.

The seal leg 202 of the front lens 200 and the seal groove 302 of a lamp body 300 are shown by A of FIG. 3 and as also shown in an enlarged form in FIG. 5, a protruded portion 203 formed on the seal leg 202 is fixed by the irregular lance engagement portion kept in engagement with a recessed portion 303 formed in the outer wall of the seal groove 302. As shown in FIG. 3, the air cylinder 550 for correcting the irregular lance engagement portion is disposed in a position corresponding to the irregular lance engagement portion in the upper jig 110.

The air cylinder 550 is fixed to the leg 114 of the upper jig 110 and horizontally disposed. A projected press portion 552 provided in the front end portion of a cylinder rod 551 that is moved back and forth is pressed against the periphery of the recessed portion 303 of the seal groove 302 so that the protruded portion 203 may be fitted into the recessed portion 303. The cylinder rod 551 (projected press portion 552) is allowed to pass through a cutout 127*a* in FIG. 3 that is provided in the support frame 127 (as will be described below) of the lower jig 120. Compressed air is supplied to the air cylinder 550 via an air hose 632 connected to the external coupler 640 as the connector portion fixed to the upper plate 112.

Negative pressure acts on the inside of the support frame 117 provided to the upper jig 110 via a negative-pressure generating port (not shown) provided to the upper plate 112, whereby the front lens 200 is stuck fast to the support frame 117 so as to be suspended by the upper jig 110.

On the other hand, the cylindrical body support frame 127 capable of supporting the outer peripheral edge portion of the lamp body 300 is provided to the lower jig 120, so that the lamp body 300 can be fitted into the support frame 127 with its seal groove 302 directed upward. A securing mechanism (not shown) for securing the peripheral edge portion of the lamp body 300 thus fitted in is provided to the support frame 127, whereby the lamp body 300 is fixed to the support frame 127 and carried by the lower jig 120 (see FIG. 10).

As shown in FIGS. 1, 3, 7 and 8, further, the internal connector 510 as the connector portion on the power supply side and the internal coupler 630 as the connector portion on the side of an air tank 611 as an air supply source are provided to the upper jig support plate 24, whereas the external connector 520 as the connector portion and the external coupler 640 that can respectively be inserted into and removable from the internal connector 510 and the internal coupler 630 are provided to the upper jig 110. The external terminals 534 and 544 contained in the external connector 520 are respectively connected to the proximity switch 530 and the limit switch 540 via the power supply cord 532 and 542, the external coupler 640 being connected via the air hose 632 to the air cylinder 550 for correcting the irregular lance engagement portion.

The internal connector 510 and the internal couplers 610 and 630 on the equipment operating element supply side can be mated with the external connector 520 and the external coupler 620 and 640 on the equipment side respectively and automatically by lowering a slide unit 130 when the upper jig 110 is coupled to the upper jig support plate 24 by lowering the upper jig support plate 24.

More specifically, a first plate 132 supported by four rods 131 is horizontally disposed on the upper jig support plate 24, and an elevator plate 134 that is vertically movable by an air cylinder 133 is provided below the plate 132. Reference numeral 135 denotes a stopper for setting the descent end position of the elevator plate 134. A fixing screw 138 is projected downward from the four corners of the elevator plate 134 via a first spacer 136 and a second spacer 137. A slide plate 139 is incorporated in the cylindrical portion 137*a* of the second spacer 137 in such a way as to be horizontally slidable. A circular hole 139*a* provided in the slide plate 139 is idly mated with the cylindrical portion 137*a* of the spacer.

A positioning pin 700, the internal connector 510, and the internal couplers 610 and 630 respectively engaging with an pin engagement hole 710, the external connector 520, and the external couplers 620 and 640 are provided to the slide plate 139 to form the slide unit 130. The front end portion 702 of the pin 700 is shaped in the form of a pointed end and when the front end portion 702 of the pin 700 is completely mated with the pin engagement hole 701, the slide plate 139 (slide unit 130) slides horizontally as the pin 700 is inserted into the hole 710. Then the internal connector 510 and the internal couplers 610 and 630 are positioned so that they can vertically be inserted into and removed from the external connector 520 and the external couplers 620 and 640.

The difference between the outer diameter of the cylindrical portion 137*a* of the spacer and the inner diameter of the circular hole 139*a* is set equal to the radius of the pin engagement hole 710, and the center of the positioning pin 700 is set to coincide with that of the pin engagement hole 710, whereby even through the jig 100 (upper jig 110) is slightly horizontally shifted from the jig support table 10, the front end portion 702 of the pin 700 is positioned inside the engagement hole 710 (see the position shown by imaginary lines of the pin 700 in FIG. 7).

The insert mechanism 129 for positioning the connector is thus constituted of the slide unit 130 that incorporates the positioning pin 700, the internal connector 510 and the internal couplers 610 and 630 and is horizontally slidable, the air cylinder 133 for moving up and down the slide unit 130 relative to the upper jig support plate 24, and the pin engagement hole 710, the external connector 520 and the external couplers 620 and 640 that are provided to the upper plate 112 of the upper jig 110.

The seal leg 202 of the front lens 200 is provided along the peripheral edge of the front lens 200. As shown by letter B in FIG. 3, and also shown in an enlarged view of FIG. 6, however, an screw insert hole 204 for disposing a fastening screw 400 is provided in position in the peripheral direction of the seal leg 202. The seal leg 202 and the seal groove 302 (the front lens 200 and the lamp body 300) are mechanically fixed by screwing the fastening screw 400 into the screw insert hole 204 from the base wall 304 of the seal groove.

As shown in FIG. 3, the support frame 127 of the lower jig 120 is made slightly greater than the opening 16 of the bed plate 12 of the jig support table 10. Further, vertical through-holes 128*a* and 128*b* corresponding to the screw insert hole 204 provided in the seal leg 202 of the front lens 200 are provided in the support frame 127 and the lower plate 122 whereby to allow screw fastening using the screw fastener body 30 via the vertical through-holes 128*a* and 128*b*. The vertical through-holes 128*a* and 128*b* are bit-holder through-holes through which the bit holder 38 of the screw fastener body 30 (as will be described below) can be passed.

As shown in FIGS. 1, 2, 9 and 10, the screw fastener body 30 that can horizontally be pivoted by the biaxial scalar robot 60 is disposed inside the jig support table 10 (below the bed plate 12).

As shown in an enlarged view of FIG. 9, the screw fastener body 30 includes a cylindrical body case 32 extending vertically, a slender rod-like rotary bit 33 extending upward from the front end opening of the body case 32, a driving motor 36 contained in the body case 32 and used to drive the rotary bit 33 to rotate, and the bit holder 38 that is slidably incorporated in the axial direction of the body case 32 in such a way as to envelope the rotary bit 33.

A compression spring 40 is installed between the base portion of the bit holder 38 and a bearing holder 36*a* in the body case 32 so as to urge the bit holder 38 upward. An engagement projection 35*a* engageable with the cross groove 404 of the head portion 402 of the fastening screw 400 is formed in the front end portion of the rotary bit 33. The fastening screw 400 dropped into the opening of the bit holder 38 with its head directed downward is caused to engage with the engagement projection 35*a* of the rotary bit 33, so that the fastening screw 400 is integrally joined to the rotary bit 33 in the peripheral direction.

A negative suction port 44 in FIG. 9 acts as what facilitates the engagement of the front end portion (engagement projection 35*a*) of the rotary bit 33 with the fastening screw 400 (cross groove 404) by generating an air current downward within the bit holder 38 so as to hold the fastening screw 400 upright within the bit holder 38.

The screw fastener body 30 is disposed in parallel to the rodless air cylinder 50 that is supported by the arm 68 of and biaxial scalar robot 60 and vertically extended and so arranged that the screw fastener body 30 may be moved up and down by the rodless air cylinder 50. More specifically, the rodless air cylinder 50 is vertically disposed such that the body case 32 of the screw fastener body 30 is integrally coupled to a slider 52 vertically slidably incorporated with the cylinder body 51, so that when the rodless air cylinder 50 is operated, the screw fastener body 30 together with the slider 52 is moved up and down. A blurring-preventive holder guide 54 is provided in the upper end portion of the air cylinder 50.

Further, the rodless air cylinder 50 operates right below an estimated screw fastening position P2 (bit-holder inserting hole 128*b*) in the lamp body 300 so as to move up the screw fastener body 30 (bit holder 38). When the bit holder 38 is inserted into the bit-holder insert hole 128*b* and when its front end portion is brought into contact with the different-in-level portion (not shown) of the bit-holder insert hole 128*b*, the bit holder 38 is unable to move up further, so that any portion excluding the bit holder 38 of the screw fastener body 30 is moved up. At this time, the bit holder 38 is moved back relative to the body case 32 and when the bit holder 38 is moved back by a predetermined quantity, the quantity is detected to make the rotary bit 33 start its rotation. Then the screw fastener body 30 is moved up against the urging force of a spring 40 for urging the bit holder 38. The cross groove 404 of the head portion 402 of the fastening crew 400 engages with the front end engagement projection 35*a* of the rotary bit 33 contained in the bit holder 38 so as to peripherally integrate the rotary bit 33 with the fastening screw 400, when the rotary bit 33 is moved up while rotating, whereby the rotary bit 33 is passed through (the seal groove base wall 304 of) the lamp body 300 in order to screw the fastening screw 400 into the predetermined screw insert hole 204 of the front lens 200.

As shown in FIG. 2, the biaxial scalar robot 60 includes a horizontal pivoting mechanism having a pair of vertical first arms 64 horizontally pivoting around a first vertical axis 62 fixed to the jig support table 10, and a second arm 68 horizontally pivoting around the second vertical axis 66 provided in the pivoting front end portion of the first arm 64. The screw fastener body 30 is allowed by the horizontal pivoting mechanism 61 to horizontally and efficiently move between a position P1 where the head of each fastening crew 400 is dropped with its head directed downward and a position P2 as an estimated position where the screw is fastened in a predetermined manner.

In FIG. 2, reference numeral 72 denotes a screw supply unit for supplying fastening screws 400 with their heads directed upward; 80, a screw inversion supply unit for dropping the inverted fastening screw 400 supplied from the screw supply unit 72 into a screw dropping hole 78; and 74 and 76, a fastening crew carrier hoses.

A description will now be given of the process of automatically pressure-welding screws from below the lamp body 300 in order to pressure-weld the lamp body 300 and the front lens 200 by using the apparatus according to the invention.

First, the jig 100 having the upper jig 110 and the lower jig 120 combined together with the legs 114 and 124 in vertical engagement with each other is carried onto the bed plate 12 of the jig support table 10. Then the roller 125 of the lower jig 120, and the plunger pin 116*a* are respectively made to engage with the hole 14 of the bed plate 12 and the engagement hole 13 whereby to position the jig 100 relative to the jig support table 10.

Then the upper jig support plate 24 is lowered up to a position where it is brought into contact with the upper jig 110 and the plunger pin 116*a* projected upward from the upper jig 110 is made to engage with the engagement hole 13 on the side of the upper jig 110 so as to position the upper jig 110 relative to the upper jig support plate 24.

When the air cylinder 133 is operated to lower the slide unit 130, further, the positioning pin 700 is inserted into the engagement hole 710. Simultaneously, the internal connector 510 and the internal couplers 610 and 630 of the slide unit 130 are securely inserted into the external connector and the external couplers 620 and 640 of the upper jig 110, respectively.

Further, the upper jig support plate 24 and the upper jig 110 are combined together by operating the damper 27. Thus, the upper jig 110 is combined with the upper jig support plate 24. The power supply cords 536 and 546, and the air hose 636 on the side of the upper jig support plate 24 are connected to the power supply cords 532 and 542, and the air hose 632 on the side of the equipment (proximity switch 530, the limit switch 540 and the air cylinder 550 for correcting the irregular lance engagement portion) provided to the upper jig 110 via the connector 500 and the coupler 600. Consequently, the current and compressed air are supplied to each of the equipment (530, 540 and 550), so that these kinds of equipment become operable.

The upper jig support plate 24 (upper jig 110) is moved up to increase the space between the upper jig 110 and the lower jig 120. Then the front lens 200 is set to the upper jig 110 (of the support frame 117) by fitting the lamp body 300 into the lower jig 120 (of the support frame 127) so as to mount a seal material 306 in the seal groove 302 of the lamp body 300. Further, the upper jig support plate 24 (upper jig 110) is lowered to make the seal leg 202 engage with the seal groove 302 so as to pressure-weld the front lens 200 to the lamp body 300.

The biaxial scalar robot 60 starts operating simultaneously when the lens 200 is pressure-welded to the body 300. In other words, the fastening screws are dropped into the bit holder 38 of the screw fastener body 30 just below the screw dropping hole 78 and upon receipt of the fastening screws 400, the screw fastener body 30 is horizontally pivoted and placed just below the estimated screw fastening position P2. Then the rodless air cylinder 50 operates to move up the screw fastener body 30, and the bit holder 38 is inserted into the opening 13 and the through-holes 128*a* and 128*b*. Then the rotary bit 33 (bit body 35) rotates and causes the fastening screw 400 to break through the seal groove base wall 304, so that the seal leg 202 and the seal groove 302 are fastened with the screws when the seal leg 202 is screwed into the screw insert hole 204.

In the slide unit 130 according to this embodiment of the invention, though the positioning pin 700 is provided to the slide plate 130 and though the pin engagement hole 710 is provided to the upper jig 110, any positioning pin may be provided in the upper jig 110, whereas a corresponding pin engagement hole may also be provided in the slide plate 139.

As is obvious from the description given above, the provision of the electric/fluid equipment for applying predetermined processes to lamp component members for the upper jig in the vehicle-lamp assembly apparatus results in improving its assembly functions without increasing the size of the assembly apparatus and without complicating the construction thereof. This also improves the lamp assembly line in that the number of assembly apparatuses on the assembly line is decreased.

Further, the first and second connector portions can automatically be joined and separated by moving up the first connector portion without any manual work on the part of worker and this reduces not only the burden imposed on the worker but also the possibility of connecting the connector portions improperly.

Since the positioning mechanism regulates the positions of the first and second connector portions so that the first connector portion can vertically be inserted into or removed from the second connector portion, both the connector portions are smoothly and simply joined together and separated from each other and so are the equipment-operating element supply passages between the upper jig and the upper jig support plate.

Moreover, since both the connector portions are surely joined when at least the front end portion of the positioning pin engages with the engagement hole, the work of connecting the equipment-operating element supply passages between the upper jig and the upper jig support plate is greatly facilitated.

While this invention has been described in connection with what is presently considered to be the most practical and preferred embodiment, it is to be understood that the invention is not limited to the disclosed embodiment, but, on the contrary, it is intended to cover various modifications within the spirit and scope of the appended claims.

What is claimed is:

1. A vehicle-lamp assembly apparatus comprising:

a lower jig for supporting a lamp component member;

a jig support table on which said lower jig is positioned and mounted;

an upper jig vertically engaged with said lower jig, said upper jig supporting another lamp component member, and said upper jig including electric and/or fluid equipment which functions to permit a predetermined process to be performed on the lamp component member and the another lamp component member;

an upper jig support plate for supporting said upper jig via a coupling mechanism in a suspended condition; and an elevator mechanism for moving said upper jig support plate up and down with respect to said jig support table, wherein said upper jig support plate includes a first supply passage for supplying electricity and/or fluid to said electronic and/or fluid equipment, said upper jig includes a second supply passage extending to said electric and/or fluid equipment, said first and second supply passages being connected via a connector, the connector including a first connector portion on a side of said first supply passage and a second connector portion on a side of said second supply passage, said first and second connector portions being detachable from each other, and wherein the electricity and/or fluid are supplied to said electric and/or fluid equipment via said first and second supply passages, and said first connector portion being movable relative to said upper jig support plate.

2. A vehicle-lamp assembly apparatus as claimed in claim 1, further comprising a positioning mechanism between the first connector portion and the second connector portion.

3. A vehicle-lamp assembly apparatus as claimed in claim 2, wherein said connector is an electric-wire and/or a fluid-pipe connecting connector.

4. A vehicle-lamp assembly apparatus as claimed in claim 2, wherein said positioning mechanism includes a slide plate with said upper jig support plate and capable of horizontally sliding by a predetermined quantity, a pointed end of a positioning pin that is directed downward from said slide plate, and an engagement hole for engaging with said positioning pin.

5. A vehicle-lamp assembly apparatus as claimed in claim 4, wherein said connector is an electric-wire and/or a fluid-pipe connecting connector.

6. A vehicle-lamp assembly apparatus as claimed in claim 1, wherein said connector is an electric-wire and/or a fluid-pipe connecting connector.

7. A vehicle lamp assembly apparatus as claimed in claim 1, wherein said first connector portion is movable relative to said upper jig support plate in a direction toward and away from said second connector portion.

8. A vehicle lamp assembly apparatus as claimed in claim 1, further comprising air cylinders for moving said first connector portion relative to said upper jig support plate.

9. A vehicle lamp assembly apparatus as claimed in claim 1, further comprising a screw fastener contained in the jig support table to screw a fastening screw between the lamp component members.

10. A vehicle lamp assembly apparatus as claimed in claim 1, wherein said fluid equipment uses air as fluid.

* * * * *